US007216773B2

(12) United States Patent
Golias, Jr. et al.

(10) Patent No.: US 7,216,773 B2
(45) Date of Patent: May 15, 2007

(54) QUICK ASSEMBLY STORAGE CABINET

(75) Inventors: Bernard J. Golias, Jr., Twinsburg, OH (US); Gary W. James, Parma Heights, OH (US); Gary R. Kish, Parma, OH (US); Robert J. Golias, Solon, OH (US)

(73) Assignee: Metal Fabricating Corporation, Cleveland, OH (US)

( * ) Notice: Subject to any disclaimer, the term of this patent is extended or adjusted under 35 U.S.C. 154(b) by 223 days.

(21) Appl. No.: 10/978,649

(22) Filed: Nov. 1, 2004

(65) Prior Publication Data

US 2005/0109722 A1 May 26, 2005

(51) Int. Cl.
*A47F 5/00* (2006.01)

(52) U.S. Cl. ..... 211/184

(58) Field of Classification Search ..... 211/186, 211/184, 194, 195
See application file for complete search history.

(56) References Cited

U.S. PATENT DOCUMENTS

| | | | | |
|---|---|---|---|---|
| 397,012 | A * | 1/1889 | Lyons | 211/184 |
| 3,216,587 | A * | 11/1965 | Anders | 211/184 |
| 4,372,522 | A * | 2/1983 | Simeonoff | 249/18 |
| 6,010,015 | A * | 1/2000 | Lin | 211/40 |
| 6,615,999 | B1 * | 9/2003 | Culp | 211/186 |
| RE38,707 | E * | 3/2005 | Merkel | 211/135 |

* cited by examiner

*Primary Examiner*—Sarah Purol
(74) *Attorney, Agent, or Firm*—Fay Sharpe LLP

(57) ABSTRACT

A metal cabinet includes a plurality of horizontal shelf members and a plurality of vertical dividers. Each shelf member includes a plurality of slits extending between edges of the shelf member. Each vertical divider includes a plurality of slits extending between edges of the divider. One shelf member slit receives a divider and one divider slit receives a horizontal shelf member.

20 Claims, 10 Drawing Sheets

QUICK ASSEMBLY STORAGE CABINET

BACKGROUND OF THE INVENTION

The present invention relates generally to units for storage. More particularly, the invention relates to an improved compartment bin that is easily and quickly assembled.

Metal compartment bins and cabinets are some of the most versatile pieces of furniture available. The cabinets can be hung in work areas such as metal or woodworking shops, garages, as well as many other places. Cabinets and compartment bins can also provide storage in vehicles such as trucks and vans. Metal cabinets also provide versatility in what they store. For example, metal cabinets and compartment bins have been used to store threaded rod, wire, brake line, welding rods, as well as more common items such as tools and fasteners.

Bins or cabinets having a plurality of compartments are usually assembled with numerous amounts of attachments between the components. For example, shelves can be mechanically fastened or welded to dividers. As the number of shelves and dividers increase the manufacturing process becomes both more costly and timely.

Also, conventional storage cabinets are typically first assembled at the manufacturing location and then shipped to the end buyer or consumer. Any reduction in time of assembly of the cabinet results in a lower cost for the assembled cabinet. Accordingly, it is desirable to provide a storage cabinet that is quicker and more economical to assemble.

SUMMARY OF THE INVENTION

According to an embodiment of the invention, a metal cabinet includes a plurality of shelf members and a plurality of dividers. Preferably, the shelf members are horizontally oriented in the cabinet and the dividers are vertically oriented. Each shelf member includes a plurality of slits extending from a first edge of the shelf member towards a second opposite edge of the shelf member. Each divider also includes a plurality of slits extending from a first edge towards a second opposite edge of the divider. A shelf member slit receives divider and a divider slit receives a shelf member.

BRIEF DESCRIPTION OF THE DRAWINGS

The invention takes form in certain parts and arrangements of parts, preferred embodiments of which will be described in detail in this specification and illustrated in the accompanying drawings which form a part hereof and wherein.

DETAILED DESCRIPTION OF THE INVENTION

Referring now to the Figures, the showings are for purposes of illustrating the preferred embodiments of the invention only and are not for purposes of limiting same. Directional terms such as "left," "right," "front," "rear," and the like will be used to simplify the description of the Figures only, and should not be construed as limiting the components to those directional terms.

Figure 1:
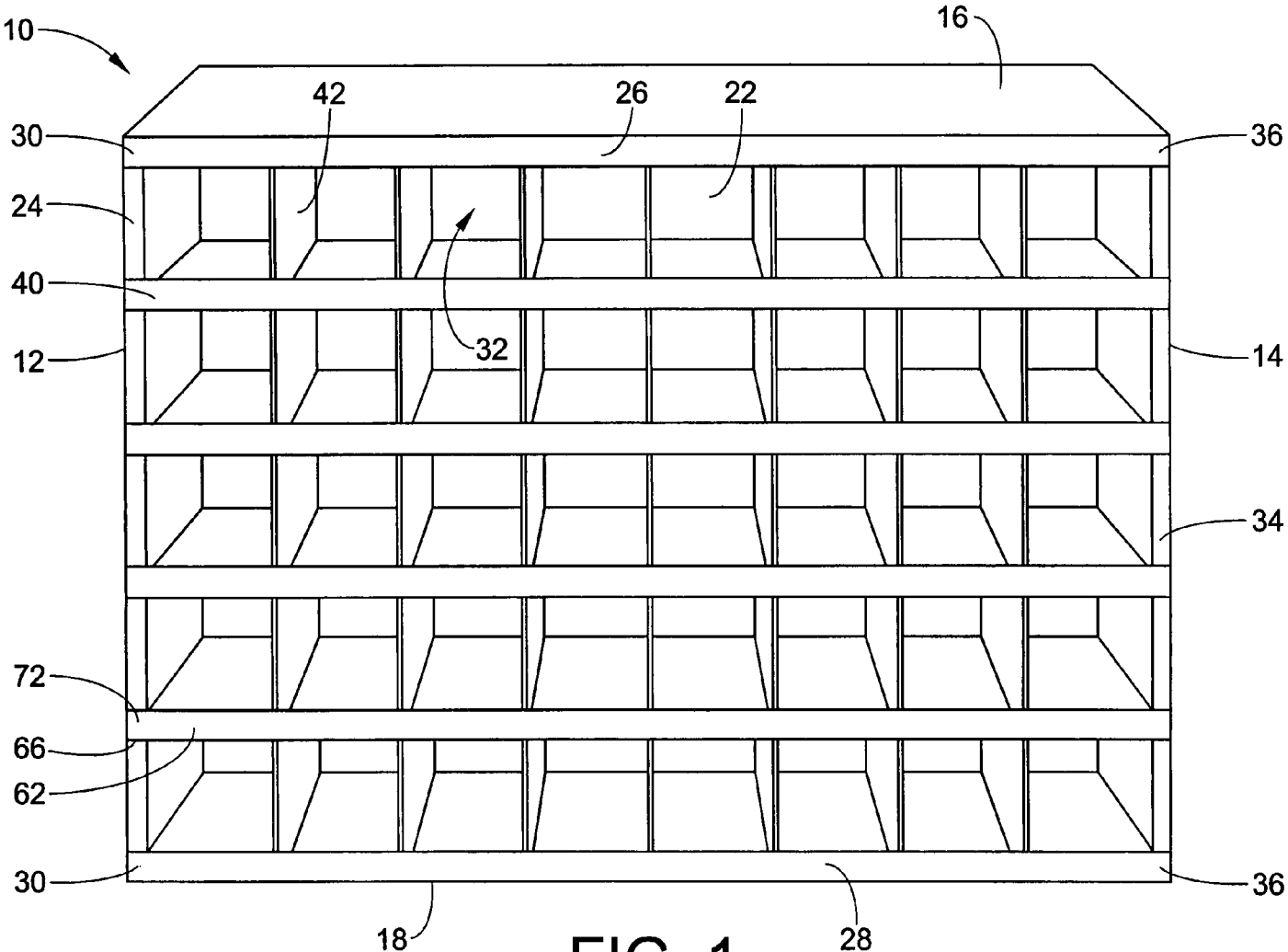
FIG. 1 is a front perspective view of a compartment bin according to the present invention.

FIG. 1 shows a compartment bin 10. The compartment bin includes a first or left side wall 12 and a second or right side wall 14 spaced from wall 12. A third or top panel 16 and a fourth or bottom panel 18 spaced from the top panel interconnect the two side walls. A fifth or rear panel 22 interconnects with the top and bottom panels and the two side walls.

Figure 2:
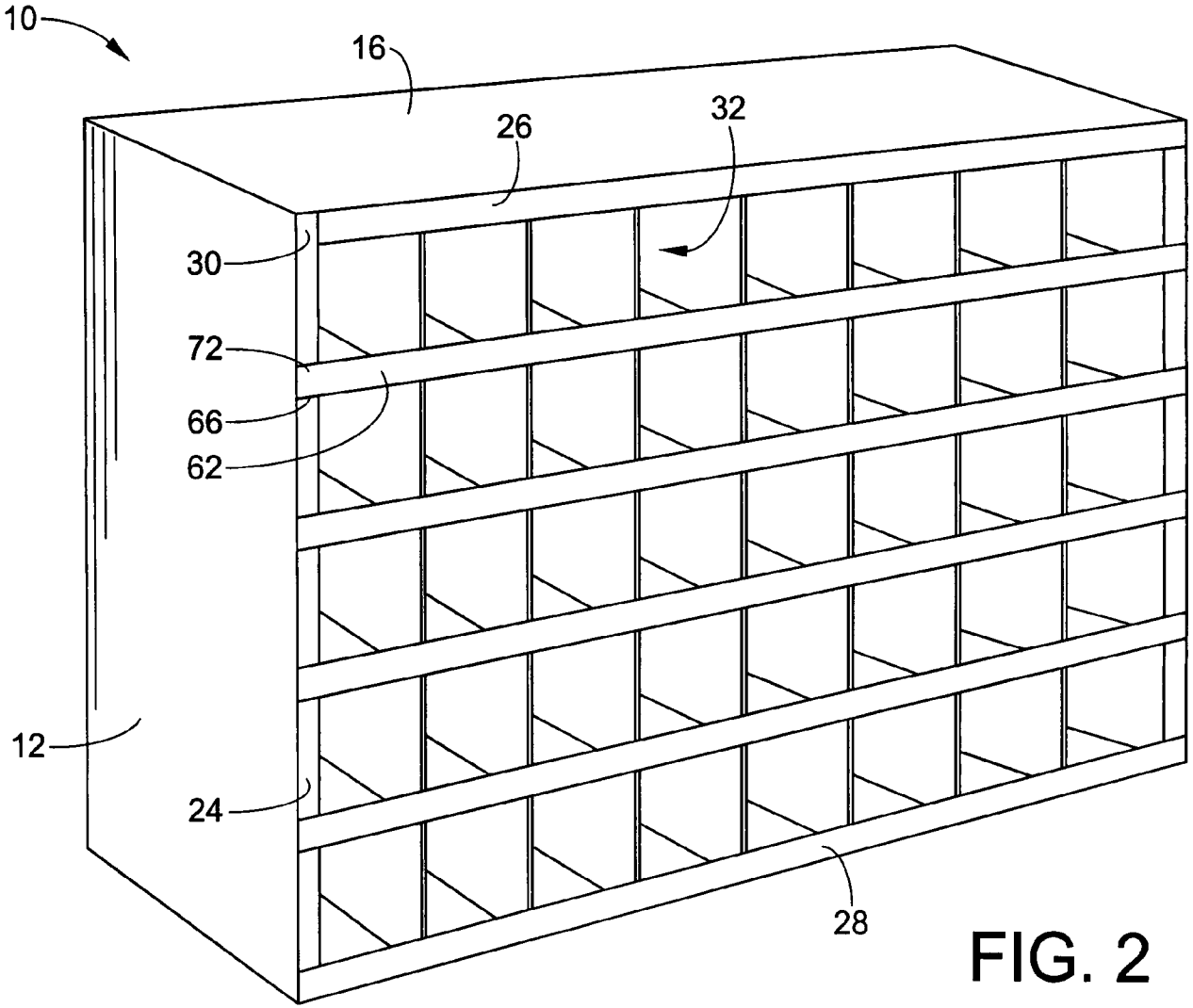
FIG. 2 is a side perspective view of the compartment bin of FIG. 1.

With reference now to FIG. 2, wall 12 includes a front tab 24 that interconnects with a front tab 26 of the top panel 16 and a front tab 28 of the bottom panel 18 via welding 30 or other suitable fastening means. The term "front" refers to the portion of the compartment bin that is open to allow the user access to compartments 32. The left side wall can interconnect with the top and bottom panel by other means, such as rivets, screws or any other conventional fastening techniques. Also, the mechanical connection can be a lance type connection that is described in commonly owned U.S. nonprovisional patent application Ser. No. 10/812,148, which is incorporated herein by reference in its entirety.

Wall 14 includes a front tab 34 that interconnects with tab 26 of panel 16 and tab 28 of panel 18 via welding 36 or other suitable fastening means. Similar to wall 12, wall 14 can interconnect with the top and bottom panel by other conventional fastening means. The side walls can further include additional tabs to connect to the rear panel 22. Furthermore, the top and bottom panels can include additional tabs to connect to both the side walls and the rear panel. In an alternative embodiment, the side walls and panels can interconnect without using the tabs disclosed, but can interconnect in any conventional manner.

Figure 3:
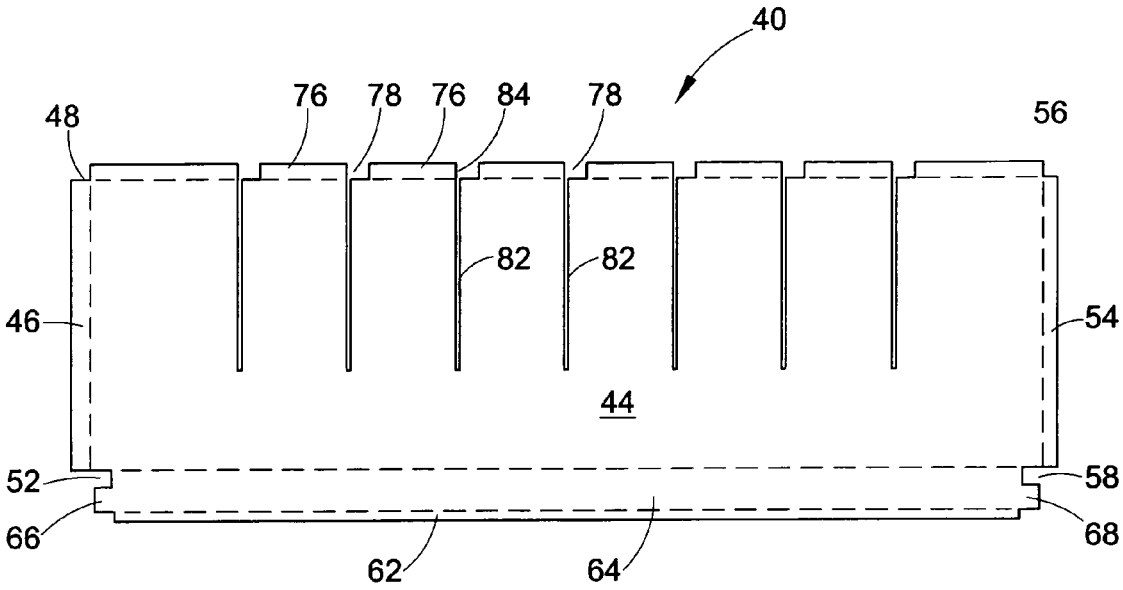
FIG. 3 is a plan view of a shelf member of the compartment bin of FIG. 1 prior to final forming.

With continued reference to FIGS. 1 and 2, the compartment bin includes a plurality of shelf members 40 and dividers 42 that define the compartments 32. The shelf members are horizontally positioned within the bin. The dividers are vertically oriented in the bin at approximately 90 degrees with respect to the shelf members. With reference now to FIG. 3, a shelf member 40 can be made from a piece of flat metal stock 44 that has portions cut out to define tabs and slits. The shelf member includes a side tab 46 defined at a rear end thereof by a square-shaped cut-out 48 and at a front end by a substantially C-shaped cut-out 52. On an opposite side of the stock 44, a side tab 54 is defined at a rear end by a square-shaped cut-out 56 and at a front end by a substantially C-shaped cut-out 58. The side tabs 46 and 54 provide a surface to mount the shelf member 40 to the side walls 12 and 14. The shelf member can mount to the side wall via any conventional technique as well as via the lance type connection.

The oppositely disposed cut-outs 52 and 58 define a front tab 62 between them which includes a crimping portion 64 defined at its longitudinal ends by an end of each of the cut-outs 52 and 58. The front tab also includes a first projection 66 defined as the remaining portion of cut-out 52 and a second projection 68 defined as the remaining portion of cut-out 58.

Figure 4:
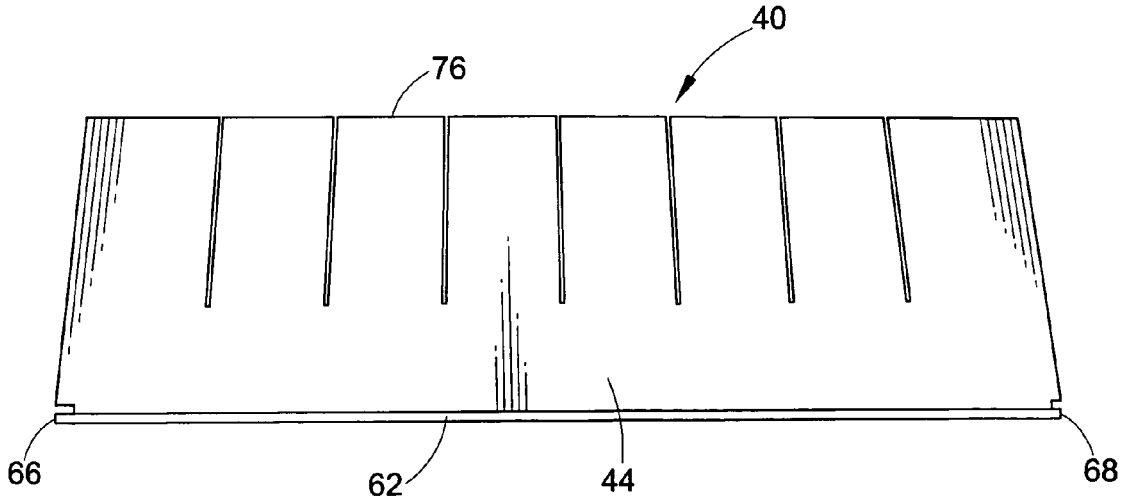
FIG. 4 is a top perspective view of the shelf member of FIG. 3 after final forming.
Figure 5:
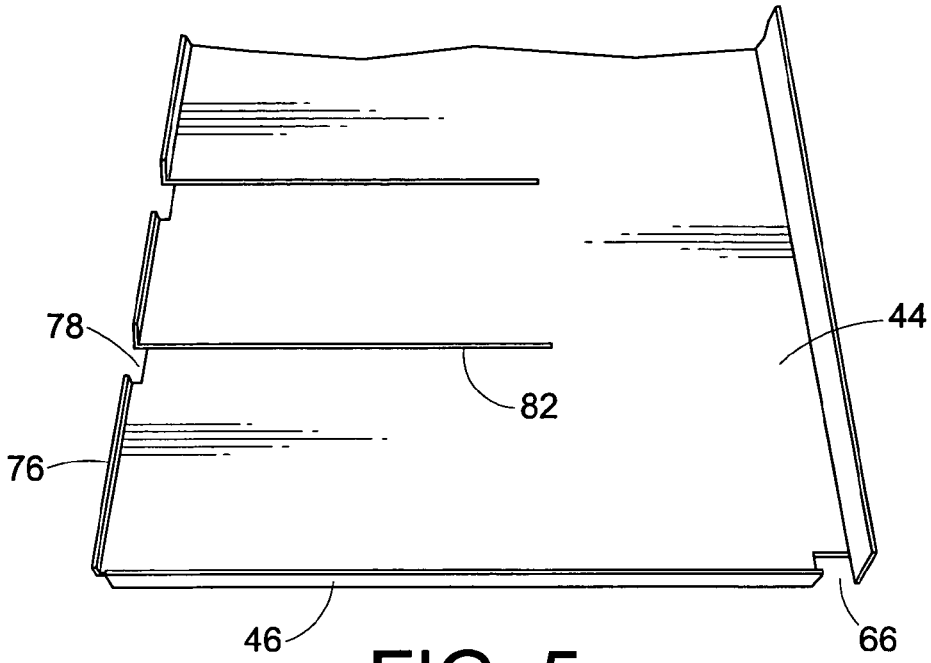
FIG. 5 is a bottom perspective view of the shelf member of FIG. 4.

When mounted in the compartment bin, the front tab is bent so that it is substantially orthogonal to the remainder of the stock 44, as best seen in FIG. 4. The crimping portion is bent over the front tab to provide a rounded lower edge for the shelf member 40. As seen in FIG. 5, the first projection 66 protrudes outwardly from the front tab 62. The first projection provides a surface to attach the shelf member to tab 24 of wall 12 (FIG. 1). The attachment between tab 24 and the first projection can be made via welding 72 or other suitable fastening means. Similarly, the second projection 68 provides a surface to attach the shelf member to the front tab 34 of wall 14 via welding 74 or other suitable fastening means. The projections can also be attached to the first panels by way of other conventional fastening techniques such as by lances.

The shelf member 40 also includes a plurality of rear tabs 76 spaced apart by cut-outs 78 and on the ends by cut-outs 48 and 56. The rear tabs provide a surface so that the shelf member can mount to the rear panel 22.

Figure 6:
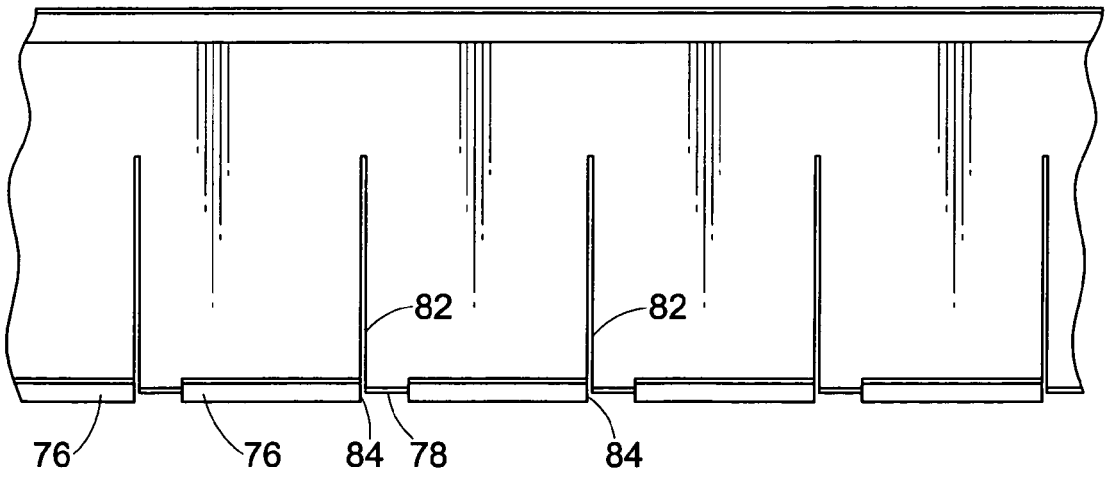
FIG. 6 is a rear perspective view of the shelf member of FIG. 4.

The shelf member also includes a plurality of slits 82 aligned with an edge 84 of the rear tabs. The alignment between slit 82 and edge 84 can be clearly seen in FIG. 6. The slits 82 run from the rear of the stock 44 towards the front about halfway through the stock. The slits receive the dividers when the compartment bin is assembled.

Figure 7:
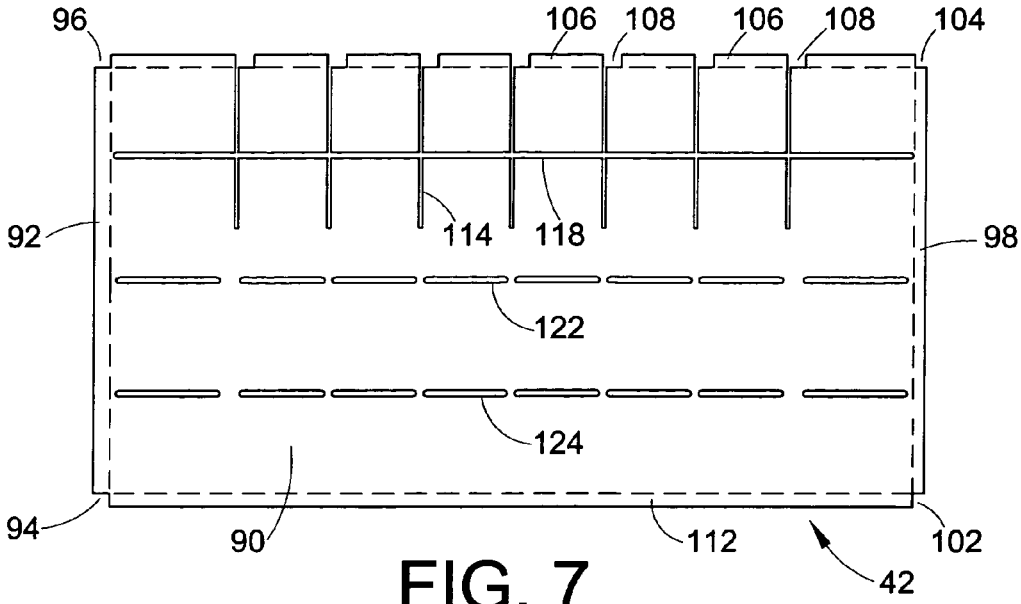
FIG. 7 is a plan view of a divider of the compartment bin of FIG. 1 after final forming.

Referring now to FIG. 7, the dividers are made from a piece of flat metal stock 90 which has portions that are cut out to define tabs. An upper tab 92 is defined at a rear end by a cut-out 94 and at a front end by a cut-out 96. Likewise, a lower tab 98 is defined at a rear end by a cut-out 102 and at a front end by a cut-out 104. The cut-outs 94, 96, 102, and 104 can be substantially square-shaped. However, they can also be other configurations without departing from the scope of the invention.

A plurality of front tabs 106 are defined at opposite ends of the stock 90 by cut-outs 96 and 104. The front tabs are also separated by notches 108 evenly spaced along the front edge. A rear tab 112 is defined by rear cut-outs 94 and 102.

Figure 8:
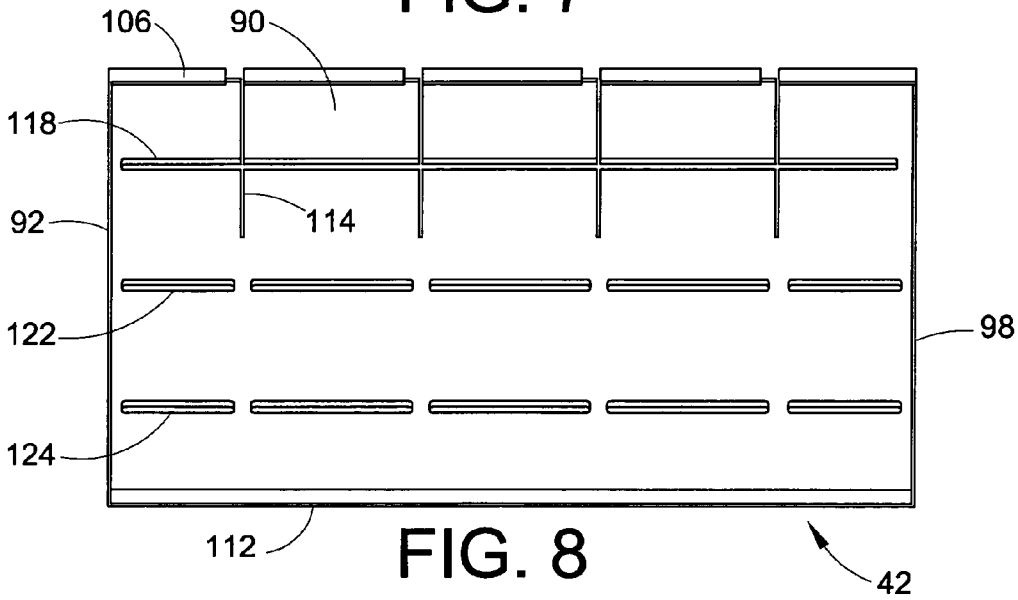
FIG. 8 is a perspective view of the divider of FIG. 7 after final forming.

As seen in FIG. 8, the tabs 92, 98 and 112 are bent such that they are substantially orthogonal to the remainder of the stock 90. The upper tab 92 provides a surface for the divider to attach to the top panel 16. The lower tab 98 provides a surface to attach to the bottom panel 18. The rear tab 112 provides a surface to attach to the rear panel 22. The divider can attach to the panels via any conventional fastening techniques, i.e. welding, riveting or via lances. The front tabs 106 are crimped to provide a rounded surface in the front of the compartment bin.

Figure 9:
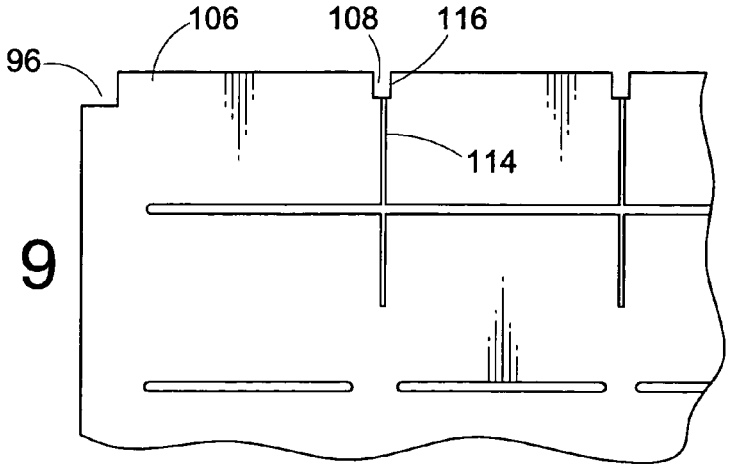
FIG. 9 is a plan view of a corner of the divider of FIG. 7.

The dividers also include slits 114 aligned with edges 116 of the front tabs 106. The slits receive a portion of the shelf members 40. The notches 108 that separate the front tabs 106 are slightly larger than the slits so that the shelf members can easily slide into the slits, as seen in FIG. 9.

The dividers also include a first corrugation 118 disposed adjacent the front tabs 106 of the stock 90. More particularly, the first corrugation is disposed towards the front third of the stock 90 and intersects the slits. A second plurality of corrugations 122 are disposed midway between the first corrugation 118 and a third plurality of corrugations 124. The second corrugations are positioned along a longitudinal center of the stock and the third corrugations are positioned towards the rear position of the stock. The corrugations provide rigidity to the dividers, especially since they will be substantially vertically situated in the compartment bin.

The assembly of the compartment bin will now be described. The compartment bin is assembled by attaching panels 16 and 18 to walls 12 and 14. The connection can be made by welds, or by other fastening means such as a lance/dimple type connection. The plurality of shelf members 40 and dividers are formed with the tabs bent as shown in FIGS. 4 and 8. The slits 82 of the shelf member 40 are aligned with slits 114 of the divider 42 or vice versa. The shelf members are then pushed rearward so that a portion of each shelf member is received in the slit 114 of the divider and a portion of each divider is received in the slit 82. Also, the divider can be pushed rearward into the slit 82 of the shelf member. The remaining dividers can then be attached to the top panel and the bottom panel and the shelf members can be attached to the side wall. The rear panel can then be attached to the dividers and the shelf members.

Figure 10:
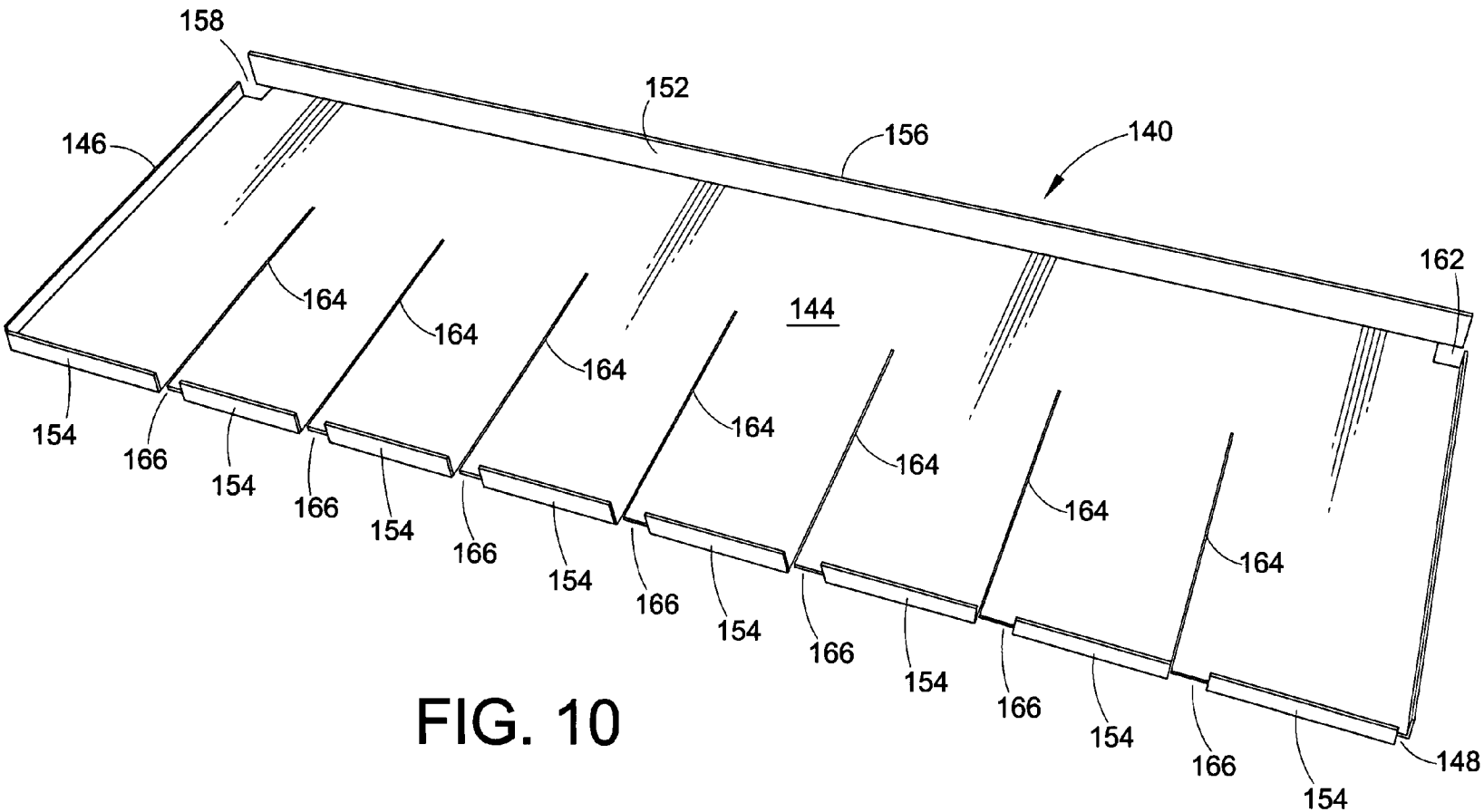
FIG. 10 is a rear perspective view of an alternative shelf member.

Referring to FIG. 10, in an alternative embodiment, a shelf member 140 includes a sheet 144, side tabs 146 and 148, a front tab 152 and a plurality of rear tabs 154. The side tabs 146, 148 extend orthogonally from the sheet 144 and provide a surface to mount the shelf member 140 to the side wall of a metal cabinet (not shown). The front tab 152 also extends orthogonally from the sheet 144. The front tab 152 can include a crimped portion 156 that is crimped over the front tab to provide a rounded or curved surface for the bottom of each front tab. The front tab also includes two projections 158 and 162, one at each longitudinal end of the front tab. The projections 158 and 162 extend outwardly from the front tab and are not connected to the sheet 144. The projections provide a surface to attach the front tab to a tab (such as tabs 24 and 34 in FIG. 1) of a side wall of a cabinet.

The shelf member also includes a plurality of slits 164 formed in the sheet 144. Each slit is positioned at a longitudinal end of a corresponding rear tab 154. The slits 164 receive a divider 142 (FIG. 11), which will be described in more detail below. The slits run from the rear of the sheet 144 towards the front about halfway through the sheet. The plurality of rear tabs 154 are spaced apart from one another by a plurality of cut-outs 166 in the sheet 144. The cut-outs receive a portion of the divider, which will be described in more detail below.

Figure 11:
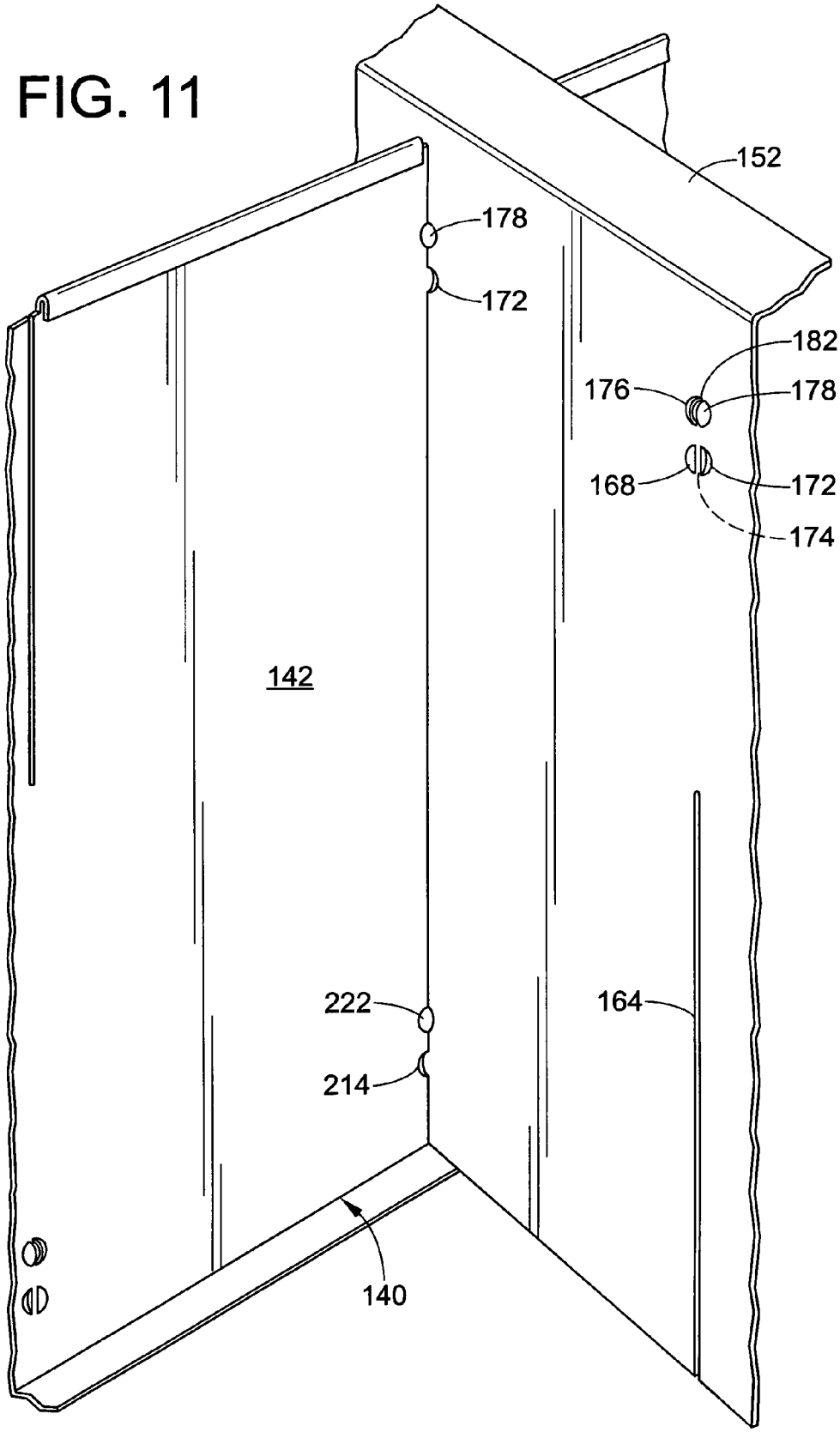
FIG. 11 is a perspective view of the alternative shelf member of FIG. 10 engaging an alternative divider.

Each shelf member also includes a plurality of raised portions or dimples aligned with a corresponding slit. With reference to FIG. 11, dimples 168 and 172 project from the shelf in the same direction as the tabs 146, 148, 152 and 154. The dimples 168 and 172 define a slot 174 (shown in phantom) that receives the divider 142. Dimples 176 and 178 are spaced from and aligned with the dimples 168 and 172 and project from the sheet in an opposite direction to the dimples 168 and 172. The dimples 176 and 178 also define a slot 182 that receives the divider 142. In an alternative embodiment, the dimples can extend all in the same direction. The dimples serve to align the divider walls and keep them rigid and stationary.

Figure 12:
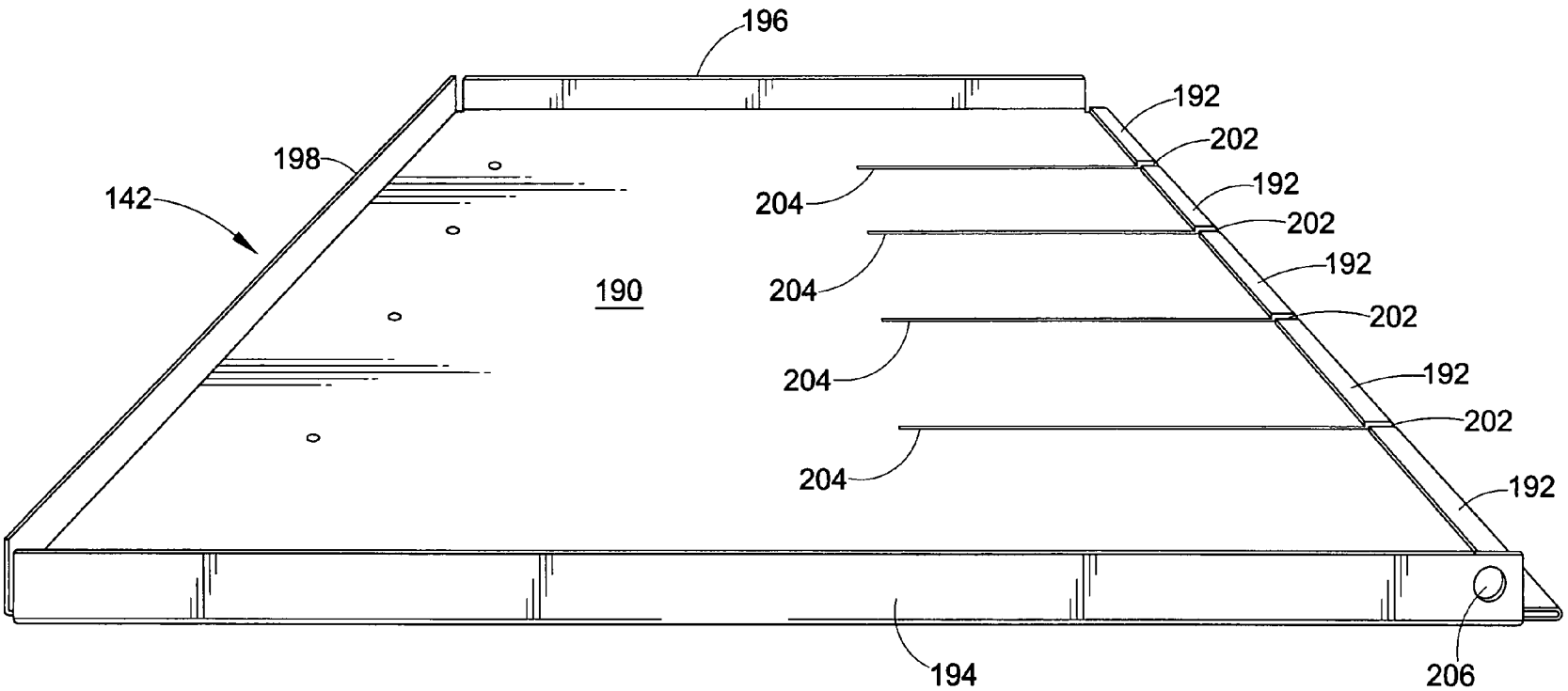
FIG. 12 is a side perspective view of the alternative divider of FIG. 11.

Referring now to FIG. 12, the divider 142 includes a sheet 190, a plurality of front crimped portions 192, an upper tab 194, a lower tab 196 and a rear tab 198. The front crimped portions 192 are separated by notches 202. The front crimped portions provide a rounded or curved edge at the front of the cabinet. The front crimped portions 192 are also divided by a plurality of slits 204. The slits receive the shelf members 140 and the notches provide a larger opening at the front of each slit to facilitate placement of the shelf members inside the slits.

The upper tab 194 extends substantially orthogonally from the sheet 190. The upper tab includes an aperture 206 that can receive a raised portion or dimple (not shown) in the top wall of the cabinet to secure the divider to the top wall. Similar to the upper tab, the lower tab 196 extends substantially orthogonally from the sheet 190. The lower tab provides a surface to attach the lower tab to the lower wall of the cabinet. The rear tab 198 also extends substantially orthogonally from the sheet 190. The rear tab is received in the notch 166 of the shelf member 140 (FIG. 10) and provide a surface to attach the divider 142 to the rear wall of the cabinet.

Figure 13:
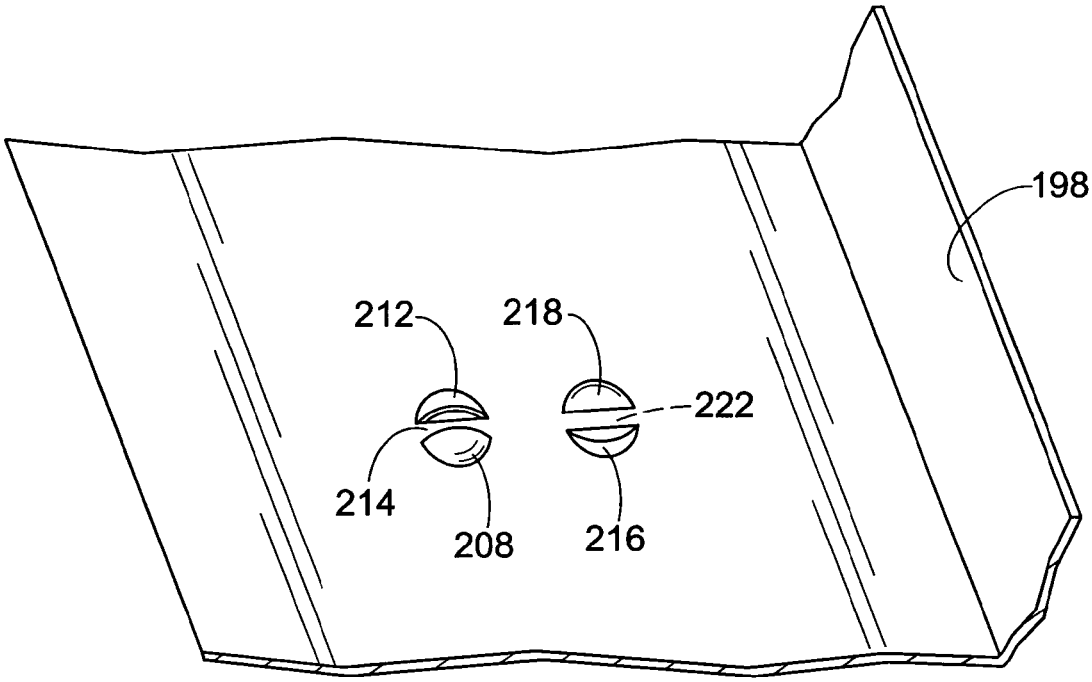
FIG. 13 is an enlarged view of raised portions on the alternative divider of FIG. 12.

The divider 142 also includes dimples similar to the dimples found on the shelf member. Referring to FIG. 13, dimples 208 and 212 project from the sheet 190 in the same direction as the tabs 194, 196 and 198. Dimples 208 and 212 define a slot 214 that receives the shelf member 140. Dimples 216 and 218 are aligned with and spaced from the dimples 208 and 212. These dimples project from the sheet 190 in an opposite direction as the dimples 208 and 212. Dimples 216 and 218 define a slot 222 (shown in phantom) aligned with the slot 214 that also receives the shelf member 140.

As seen in FIG. 11, the shelf member 140 is received in one of the slits 204 in the divider 142 and the divider is received in one of the slits 164 in the shelf member. Also, the divider is received in the corresponding slots 174, 182 in the shelf member 140. Shelf member 140 is received in the corresponding slots 214, 222 in the divider.

Figure 14:
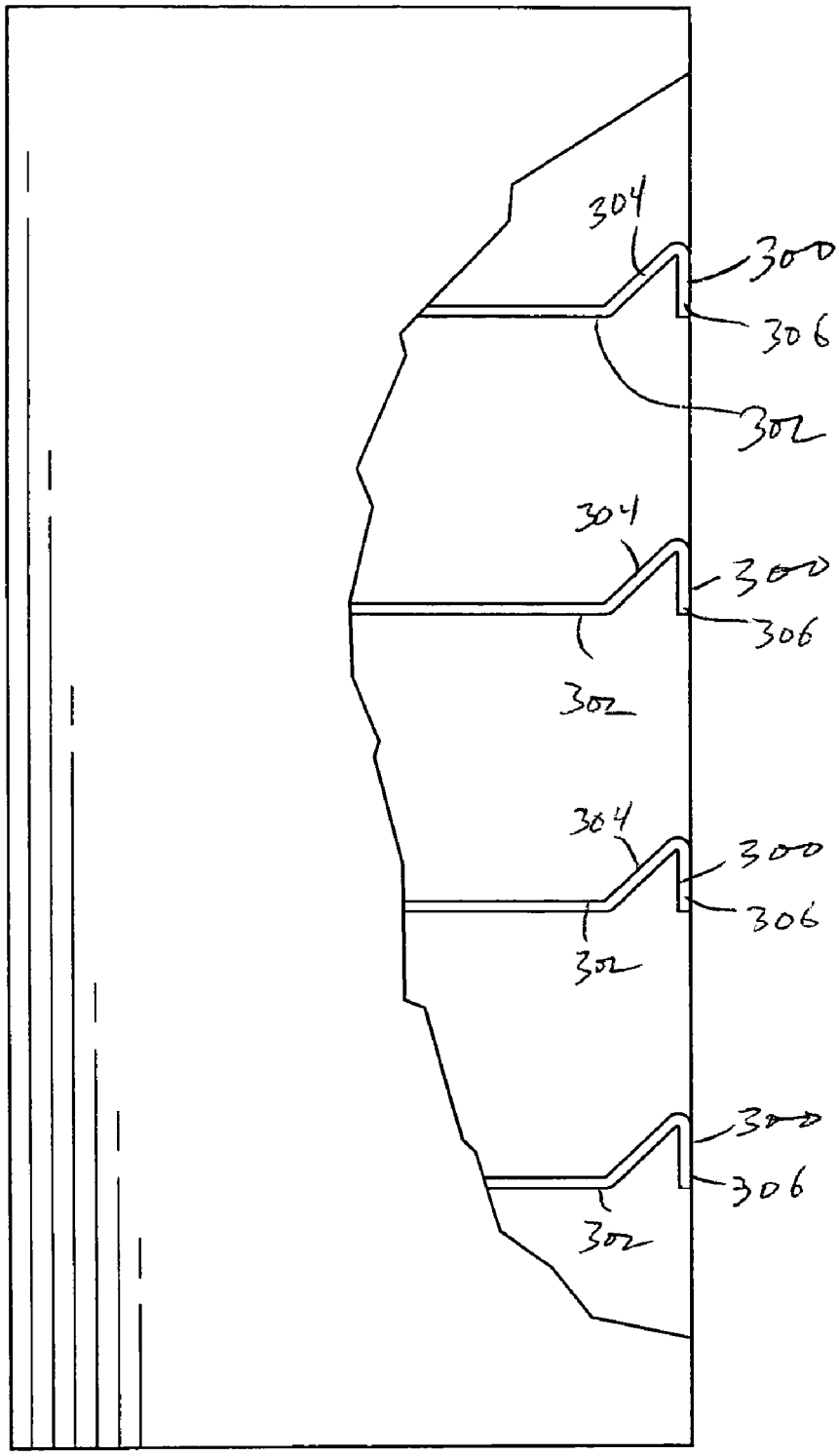
FIG. 14 is a side elevational view of an alternative compartment bin with a breakaway view of ramped shelves in accordance with another embodiment of the present invention.

Referring now to FIG. 14, an alternative embodiment of the compartment bin can include ramped portions 300 formed on a tab or front end 302 of each shelf. The ramped portion has an angled member 304 and a straight or vertical member 306 forming a substantially triangular shaped edge for the shelf. The ramped portions enable the user to more easily obtain items from within the bin by scooping or moving the items against the ramp without spilling or dropping the items as they are removed from the compartment bin. The remaining components of the bin are the same as shown in FIGS. 1–9, and 10–13.

The compartment bin can be quickly and easily assembled using the shelf members and dividers. The slits found in the shelf members and dividers enable quick assembly and disassembly of the shelf members and dividers. Furthermore, the bin can be manufactured economically and quickly. Various size bins with different sizes and numbers of compartments are further contemplated by the invention. That is, the number of compartments found may be increased or decreased by changing the number of slits in the shelf members and dividers or by changing the number of shelf members and dividers used.

The invention has been described with reference to a preferred embodiment. Obviously, modifications and alterations will occur to others upon the reading and understanding of this specification. It is intended to include all such modifications and alterations.

The invention claimed is:

1. A metal cabinet comprising:

a plurality of shelf members, wherein each shelf member includes a plurality of slits extending from a first edge of the shelf member towards a second edge of the shelf member opposite said first edge;

a plurality of dividers, wherein each divider includes a plurality of slits extending from a first edge of the divider towards a second edge of the divider opposite said first edge of said divider, wherein each shelf member slit receives a divider and each divider slit receives a shelf member;

a first side wall, wherein the plurality of shelf members are attached to said first side wall;

a second side wall, wherein the plurality of shelf members are attached to said second side wall;

wherein the shelf members each includes a plurality of shelf member notches, each shelf member notch formed in the first edge of the shelf member, wherein the dividers each includes a plurality of divider notches, each divider notch formed in the first edge of the divider; and wherein the shelf members each includes a first side tab that is oriented at an angle to a support surface of the shelf member and a second side tab that is oriented at an angle to the support surface, wherein the first side tab attaches to the first side wall and the second side tab attaches to the second side wall.

2. The metal cabinet of claim 1, wherein each of said shelf members are horizontally oriented within said cabinet.

3. The metal cabinet of claim 1, wherein each of said dividers are vertically oriented in said cabinet.

4. The metal cabinet of claim 1, further comprising a rear wall interconnecting the first side wall to the second side wall.

5. The metal cabinet of claim 4, wherein the shelf members each includes a plurality of rear tabs depending from the first edge of the shelf member perpendicular to the support surface and positioned between the shelf member slits, wherein the rear tabs attach to the rear wall.

6. The metal cabinet of claim 5, wherein the shelf members each includes a front tab depending from the second edge of the shelf member perpendicular to the support surface, wherein the front tab includes a curved edge.

7. The metal cabinet of claim 6, wherein the shelf members each includes front projections extending from each longitudinal side of the front tab, wherein each front projection attaches to a corresponding side wall.

8. The metal cabinet of claim 7, wherein the shelf members each includes a plurality of pairs of dimples that align with the slits, wherein each dimple pair includes a first and second dimple that are spaced from one another to define a slot and each slot aligns with one of said shelf member slits.

9. The metal cabinet of claim 8, further comprising a top wall and a bottom wall opposite the top wall, the top wall interconnecting the side walls and the rear wall, and the bottom wall interconnecting the side walls and the rear wall.

10. The metal cabinet of claim 9, wherein each divider includes an upper tab that abuts the top wall and a lower tab that abuts the bottom wall.

11. The metal cabinet of claim 10, wherein each divider includes a rear tab that attaches to the rear wall.

12. The metal cabinet of claim 11, wherein each divider includes a plurality of curved edges at the second edge that are positioned between the divider slits.

13. The metal cabinet of claim 12, wherein each divider includes a plurality of corrugations aligned generally perpendicular to the divider slits.

14. The metal cabinet of claim 5, wherein the shelf members each includes a front tab extending from the second edge of the shelf member perpendicular to the support surface, wherein the front tab comprises a ramped portion extending from the support surface.

15. A method for manufacturing a cabinet, the method comprising:

attaching a first side panel to a rear panel;

attaching a second side panel to the rear panel;

attaching a top panel to the first and second side panels and to the rear panel;

attaching a bottom panel to the first and second side panels and to the rear panel;

cutting a plurality of slits in a first sheet member;

cutting a plurality of slits in a second sheet member;

inserting the first sheet member into a slit of the second sheet member so that the second sheet member is received in one of said slits of the first sheet member;

attaching the first sheet member to the first side panel and the second side panel;

attaching the second sheet member to the rear panel; and forming a plurality of dimple sets in the first metal sheet member, wherein each dimple set defines a slot aligned with a corresponding slit of said first sheet member.

16. The method of claim 15, further comprising forming a flange in the first sheet member wherein the flange includes a curved edge.

17. The method of claim 15, further comprising forming a curved edge in the second sheet member wherein the curved edge is interrupted by the plurality of slits in said second sheet member.

18. The method of claim 15, wherein the step of inserting further comprises inserting the first sheet member into a slit of the second sheet member so that the second sheet member is received in the slot aligned with the slit of the first sheet member.

19. The method of claim 15, further comprising the step of forming the first sheet member from sheet metal stock.

20. The method of claim 19, further comprising the step of forming the second sheet member from sheet metal stock.

* * * * *